US005643015A

United States Patent [19]

Wakata

[11] Patent Number: 5,643,015

[45] Date of Patent: Jul. 1, 1997

[54] ASSEMBLED CONNECTOR

[75] Inventor: Shigekazu Wakata, Yokkaichi, Japan

[73] Assignee: Sumitomo Wiring Systems, Ltd., Japan

[21] Appl. No.: 611,655

[22] Filed: Mar. 6, 1996

[30] Foreign Application Priority Data

Mar. 9, 1995 [JP] Japan ..... 7-079462
Jun. 26, 1995 [JP] Japan ..... 7-183410

[51] Int. Cl.[6] ..... H01R 13/502
[52] U.S. Cl. ..... 439/701; 439/752
[58] Field of Search ..... 439/701, 717, 439/352, 353, 354, 712, 752

[56] References Cited

U.S. PATENT DOCUMENTS 5,288,251 2/1994 Sumida ..... 439/701
5,320,555 6/1994 Okabe ..... 439/701

*Primary Examiner*—Neil Abrams
*Assistant Examiner*—Yong Kim
*Attorney, Agent, or Firm*—Jordan B. Bierman; Bierman, Muserlian and Lucas LLP

[57] ABSTRACT

An assembled connector (10) comprises: a main housing (20) having a plurality of terminal-containing chambers (21) juxtaposed in the interior thereof and being provided on a top portion with a lock arm (22) adapted to engage with a mating connector; a plurality of subhousings (30) having a plurality of terminal-containing chambers (31) juxtaposed in the interior thereof and being adapted to be detachably coupled to the main housing (20); a coupling mechanism (50) for coupling each of the subhousings (30) to the main housing (20) in a manner of slide engagement; and a retainer mechanism (60) for engaging with a terminal (40) at a regular position in each terminal-containing chamber to hold the terminal (40) in the regular position. The coupling mechanism (50) is constructed so that the subhousing (30) is detachably coupled to the main housing (20) while sliding relatively on the main housing (20) in the same direction as an insertion direction of the terminal (40) with respect to the main housing (20). Alternatively, the coupling mechanism (50) is detachably constructed so that the subhousing (30) is coupled to the main housing (20) while sliding relatively on the main housing (20) in a direction perpendicular to an insertion direction of the terminal (40) with respect to the main housing (20).

5 Claims, 7 Drawing Sheets

ASSEMBLED CONNECTOR

BACKGROUND OF THE INVENTION (1) Field of the Invention

This invention relates to an assembled connector and more particularly to an assembled connector which is constructed of a plurality of connector housings.

(2) Statement of the Prior Art

A typical example of conventional assembled connectors is disclosed in Japanese Utility Model Public Disclosure No. Hei 5-90841 (1993).

For convenience of explanation, an assembled connector disclosed in the above Disclosure will be described below by referring to FIG. 8. FIG. 8 is an exploded perspective view of the prior assembled connector.

As shown in the drawing, an inner housing 2 which is formed into a box-like shape and is adapted to contain a terminal 1 therein is provided in a bottom wall thereof with recesses 3 communicated with a terminal-containing chamber and on a top wall thereof with protrusions 4 corresponding to the recesses 3. Each inner housing 2 is accommodated in an outer housing 6 with partitions 5 by stacking the inner housings 2 one after another. When one inner housing 2 is stacked on the other inner housing 2, the protrusions 4 of the lower inner housing 2 enter the recesses 3 in the upper inner housing 2. The recesses 3 are communicated with the terminal-containing chamber while the protrusions 4 engage with a rear end of a stabilizer 7 of the terminal 1, which is primarily locked on a lance (not shown) in the terminal-containing chamber, so as to effect a double lock of the terminal.

In other words, in a pair of stacked inner housings 2 and 2, the protrusions 4 on one inner housing 2 enter the recesses 3 in the other inner housing 2, thereby carrying out the dual lock of the terminal 1.

In the conventional assembled connector described above, since the protrusions 4 enter the other recesses 4 to engage with the rear end of the stabilizer 7 of the terminal 1, thereby effecting the double lock of the terminal 1, the protrusions 4 come into contact with the terminal 1 and thus cannot enter the recesses 3 in the case where the terminal 1 is not pushed to a regular position in the terminal-containing chamber. Consequently, it is impossible to stack a further inner housing 2 on the inner housing 2 with a half fitted terminal.

In the case where the inner housing 2 on the other inner housing 2, the terminal 1 has to be inserted again into the regular position in the chamber and the inner housing has to be stacked again on the other inner housing. If the inner housing is forced to be inserted downwardly into the outer housing 6 carelessly, the terminal 1 in the chamber will be broken.

In addition, since a frame like outer housing 6 and a lid 8 are required for stacking the inner housings 2, the assembled connector will be large and the member of parts will increase. The lowest inner housing requires a particular retainer to lock the terminal twice since the other protrusions 4 do not enter the recesses 3 in the lowest inner housing 2. Accordingly, if the retainer is not attached in the recesses 3 in the lowest inner housing, all inner housings on the column in the outer housing must be stacked again.

SUMMARY OF THE INVENTION

An object of the present invention is to provide an assembled connector in which a plurality of housings are easily coupled to each other without using another element such as an outer housing.

Another object of the present invention is to provide an assembled connector in which a plurality of housings can be coupled to each other without interrupting an assembling process in the case where a terminal is not inserted in a regular position in a housing.

In order to achieve the above objects, an assembled connector in accordance with the present invention comprises: a main housing having a plurality of terminal-containing chambers juxtaposed in the interior thereof and being provided on a top portion with a lock arm adapted to engage with a mating connector; a plurality of subhousings having a plurality of terminal-containing chambers juxtaposed in the interior thereof and being adapted to be detachably coupled to the main housing; a coupling mechanism for coupling each of the subhousings to the main housing in a manner of slide engagement; and a retainer mechanism for engaging with a terminal at a regular position in each terminal-containing chamber to hold the terminal in the regular position.

The coupling mechanism may be constructed so that the subhousing is detachably coupled to the main housing while sliding relatively on the main housing in the same direction as an insertion direction of the terminal with respective to the main housing. In this construction, the retainer mechanism includes through holes, which are formed in an engaging wall of the subhousing and are adapted to expose a stabilizer on a bottom of the terminal and protrusions which are formed on an engaging wall of the main housing and are adapted to enter the terminal-containing chambers in the subhousing through the through holes. The protrusion is adapted to move in the through hole in the subhousing upon relative sliding movement of the subhousing and to engage with a rear end of the stabilizer of the terminal in the regular position upon completing the relative sliding movement of the subhousing.

Preferably, the protrusion on the engaging wall of the main housing is adapted to enter the terminal-containing chamber through the through hole to push the terminal in the terminal-containing chamber to the regular position in the chamber.

The coupling mechanism may be detachably constructed so that the subhousing is coupled to the main housing while sliding relatively on the main housing in a direction perpendicular to an insertion direction of the terminal with respect to the main housing. The retainer mechanism includes recesses in and ridges on engaging walls of the main housing and subhousing. The recess communicates with the terminal-containing chamber and is adapted to receive the ridge on the engaging wall of a mating housing to bring the ridge to enable it to enter the terminal-containing chamber therein upon relative sliding movement of the subhousing on the main housing.

The ridge may be provided with a taper face on a part of a confronting surface to the terminal.

In the assembled connector of the present invention, a pair of housings provided with terminal-containing chambers are interconnected by sliding them on each other in the same direction as the insertion direction of terminals, and one housing is provided on its engaging surface with the through holes adapted to expose the rear end of the terminal while the other housing is provided on its engaging surface with the protrusions adapted to enter the through holes, respectively. Upon interconnecting the pair of housings by sliding on each other, the protrusions enter the through holes from the rear end of the terminals and move straight while sliding. In the case where the terminal is inserted in the regular position, the protrusion will come into contact with the rear end edge of the stabilizer of the terminal when the protrusion finishes sliding. In the case where the terminal is not inserted in the regular position, the protrusion will come into contact with the rear end edge from the rear side in the through hole and pushes the terminal forward while sliding. The terminal will reach the regular position when the protrusion finishes sliding.

Also, when the pair of housings provided with the terminal-containing chambers slide against each other in the same direction as the insertion direction of the terminals, the protrusions which project from the engaging surface of one housing enter the terminal-containing chambers in the other housing and the protrusions push the terminals in the chambers to the regular position while sliding.

According to the assembled connector of the present invention, it is possible to finish coupling the pair of housings with the terminals being disposed in the regular position without interrupting the coupling work, since the protrusions push the terminals to the regular position while sliding on each other in the case where the terminals are not inserted in the regular position in the chambers.

On the other hand, in the assembled connector wherein the pair of housings are interconnected by the coupling mechanism while they are sliding on their engaging walls in the direction perpendicular to the insertion direction of the terminals, the housings are not disconnected from each other in the direction perpendicular to the engaging direction after their engagement. Since the retainer mechanism includes recesses in and ridges on engaging walls of the pair of housings, the recess communicates with the terminal-containing chamber and is adapted to receive the ridge on the engaging wall of the mating housing to move the ridge so that it enters the terminal-containing chamber therein upon relative sliding movement of the housings, thereby retaining the terminals in the mating housing when the ridge on the housing enters the recess in the mating housing.

Since the ridge on the retainer is provided with a taper face on a part of a confronting surface of the terminals, the taper face pushes the terminals to the regular position while sliding even if the terminal is not disposed in the regular position.

According to the assembled connector of the present invention, it is possible to make the work of assembling easy, since the pair of housings are interconnected in a sliding manner so as to be disconnected without using a particular outer housing. Since the recesses and ridges on the engaging walls of the housings are interconnected so as to come into contact with the terminals, a particular retainer is required. Moreover, since the relative sliding direction between the ridge and the recess is perpendicular to the insertion direction of the terminal, it is possible to enhance a retaining force of the terminal. If the ridge does not enter the recess, this will indicates that the terminal is in a half fitting position or irregular position.

The taper face on the ridge can push the terminal in the half fitting position to the regular position. In particular, the housings can slide on each other in the direction parallel to the engaging surfaces. A long sliding distance can move the terminal slowly and smoothly.

DETAILED DESCRIPTION OF THE PREFERRED EMBODIMENTS

Figure 1:
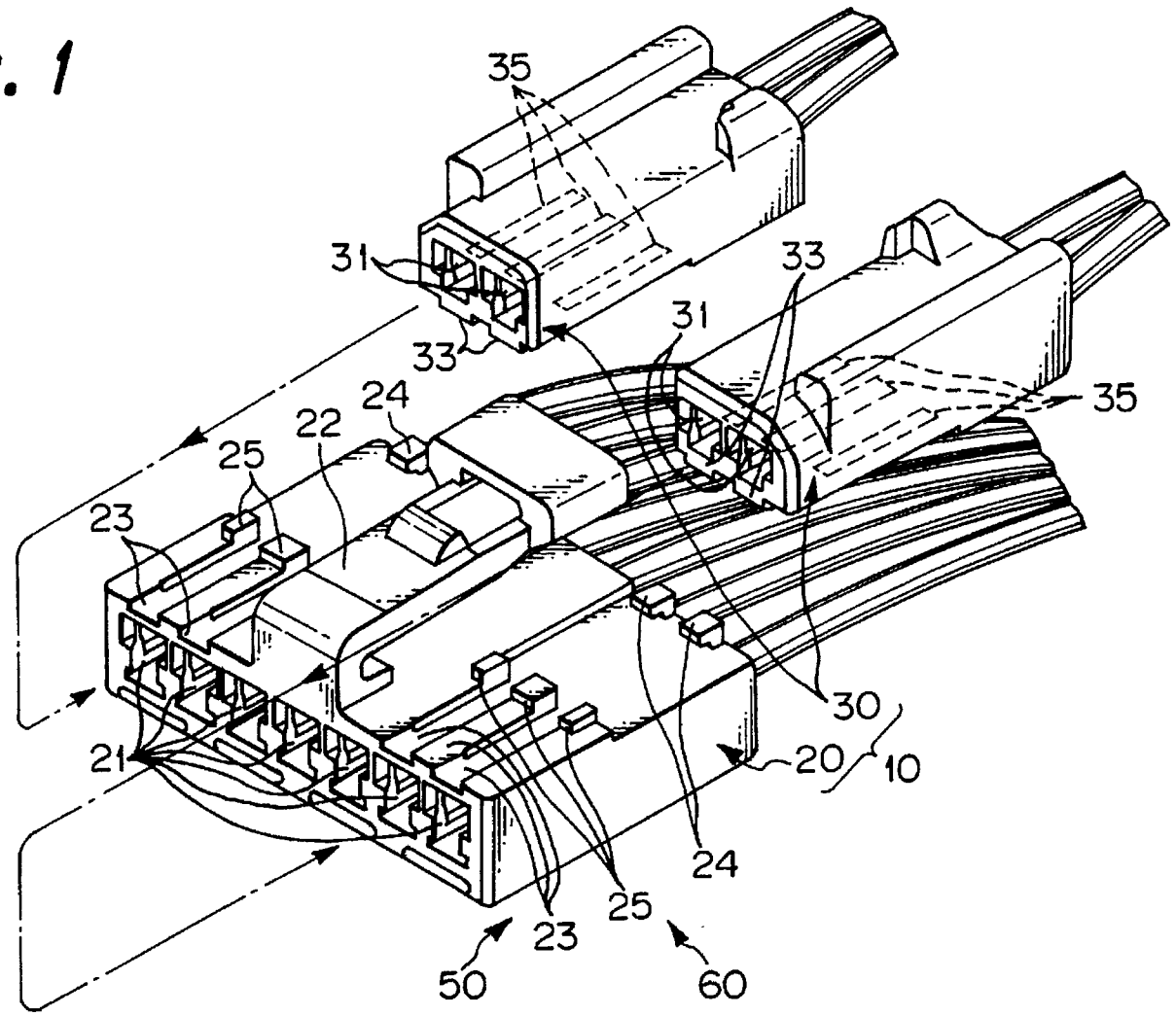
FIG. 1 is an exploded perspective view of an embodiment of an assembled connector in accordance with the present invention.

An embodiment of an assembled connector in accordance with the present invention will be described below by referring to the drawings.

Figure 2:
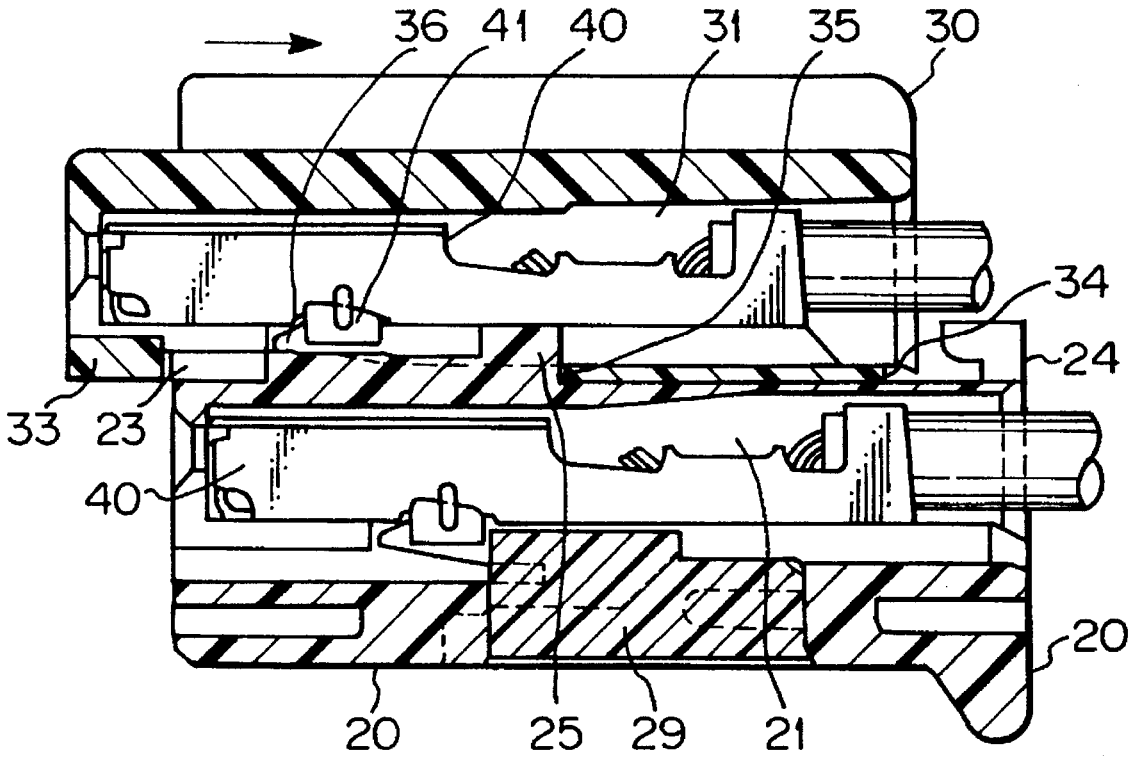
FIG. 2 is a longitudinal sectional view of the assembled connector, illustrating a primary step of the connector.
Figure 3:
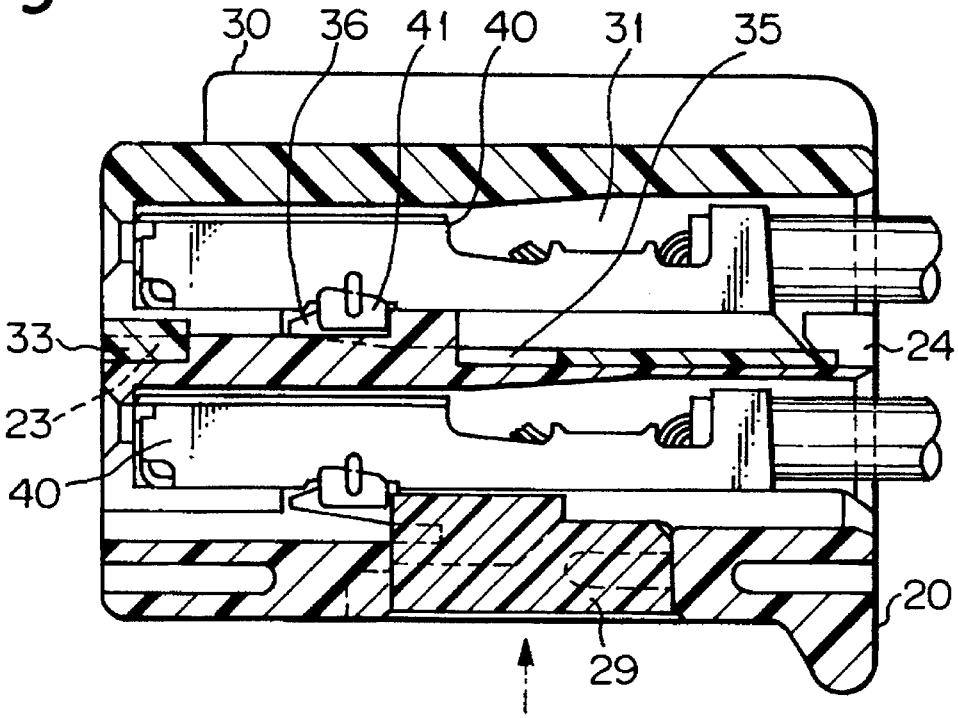
FIG. 3 is a longitudinal sectional view of the assembled connector, illustrating a final step in the assembling process of the connector.
Figure 4:
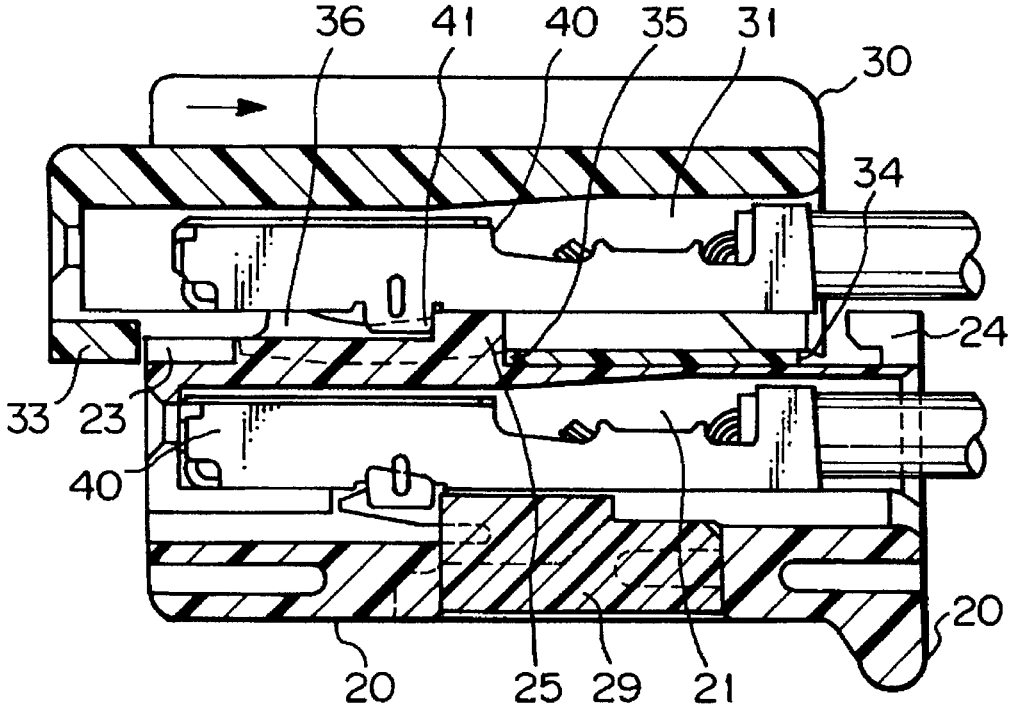
FIG. 4 is a longitudinal sectional view of the assembled connector, illustrating a primary step in the assembling process of the connector in which a terminal is in a half-fitting position.
Figure 5:
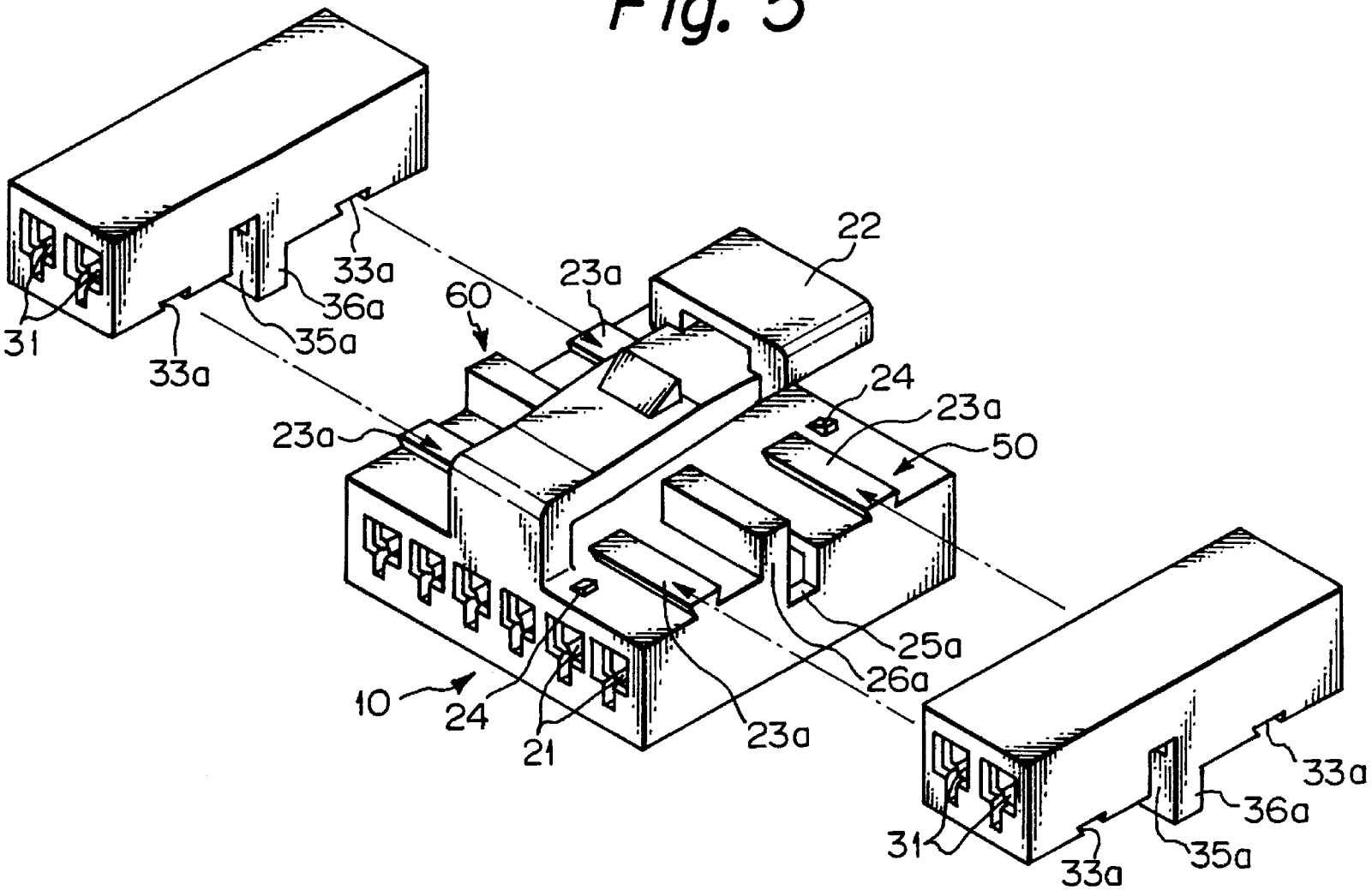
FIG. 5 is an exploded perspective view of another embodiment of the assembled connector in accordance with the present invention.
Figure 6:
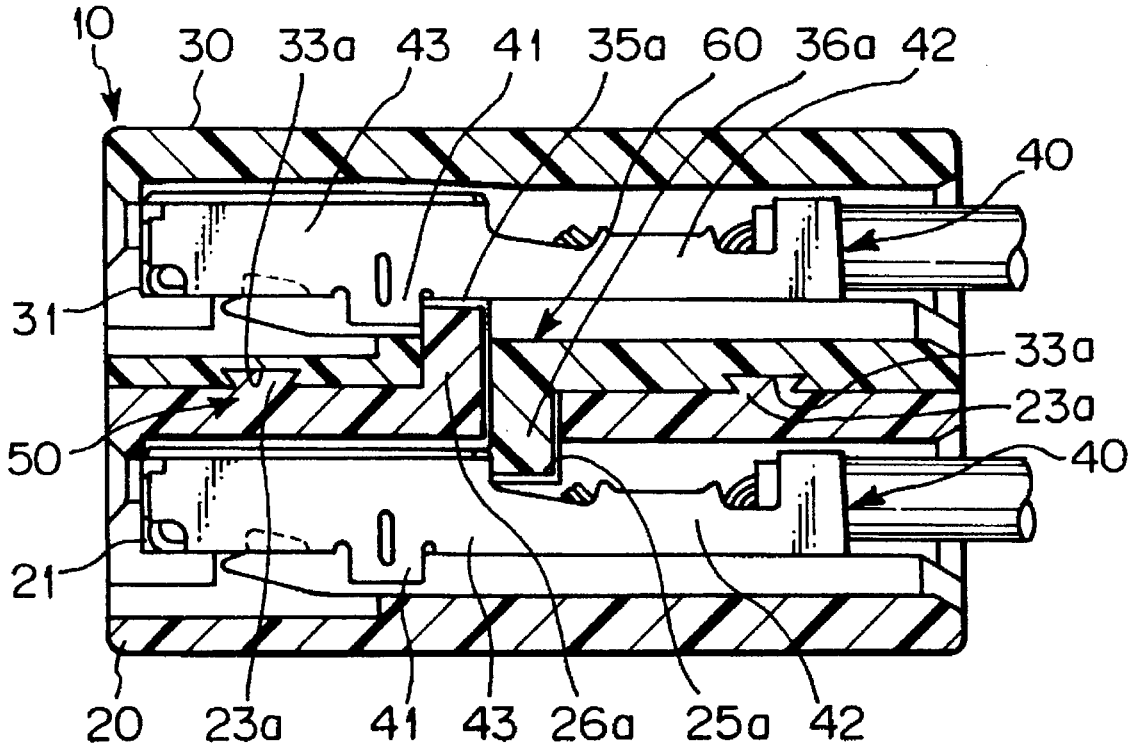
FIG. 6 is a longitudinal sectional view of the connector shown in FIG. 5, illustrating a final step in an assembling process of the connector.
Figure 7:
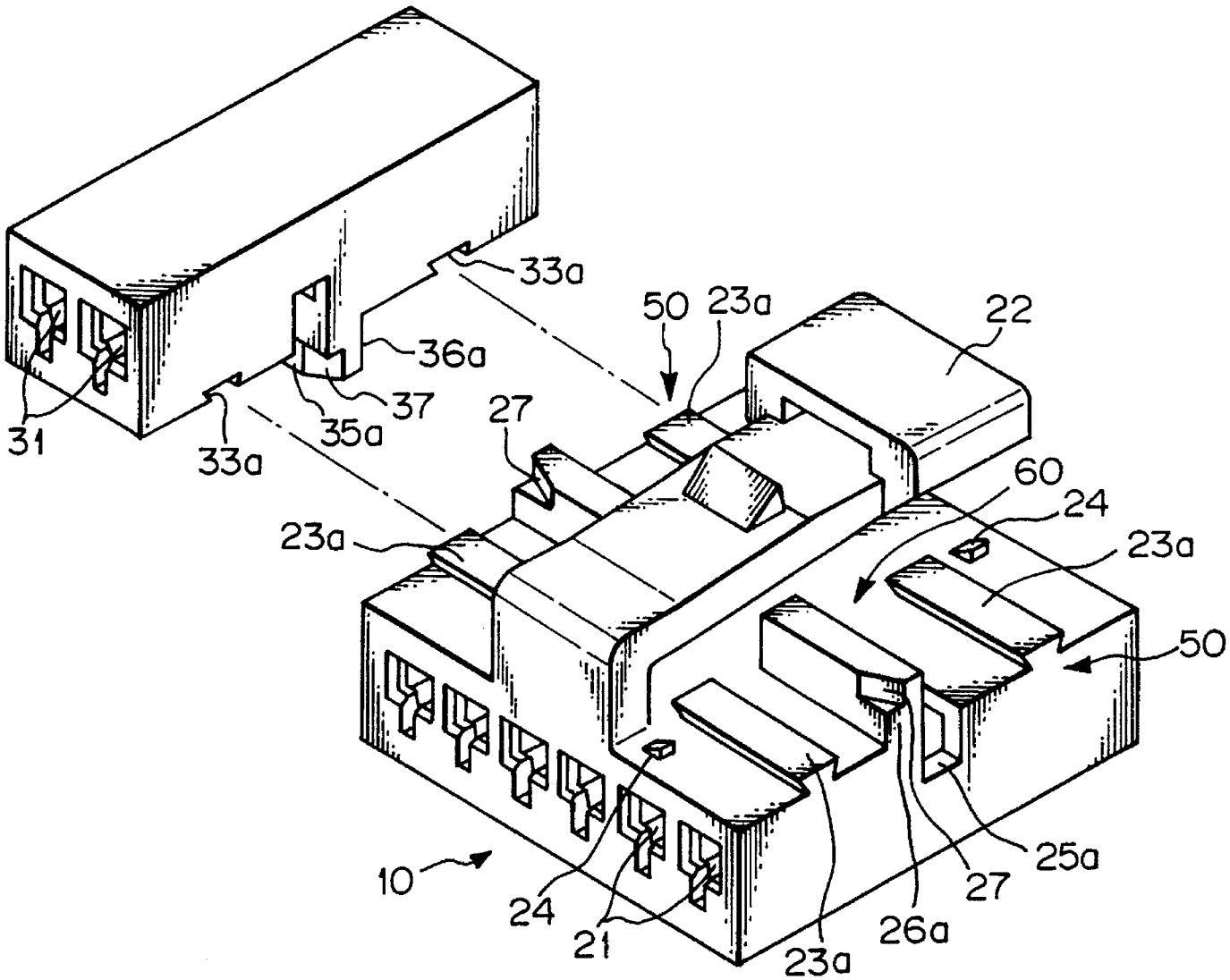
FIG. 7 is an exploded perspective view of still another embodiment of the assembled connector in accordance with the present invention.
Figure 8:
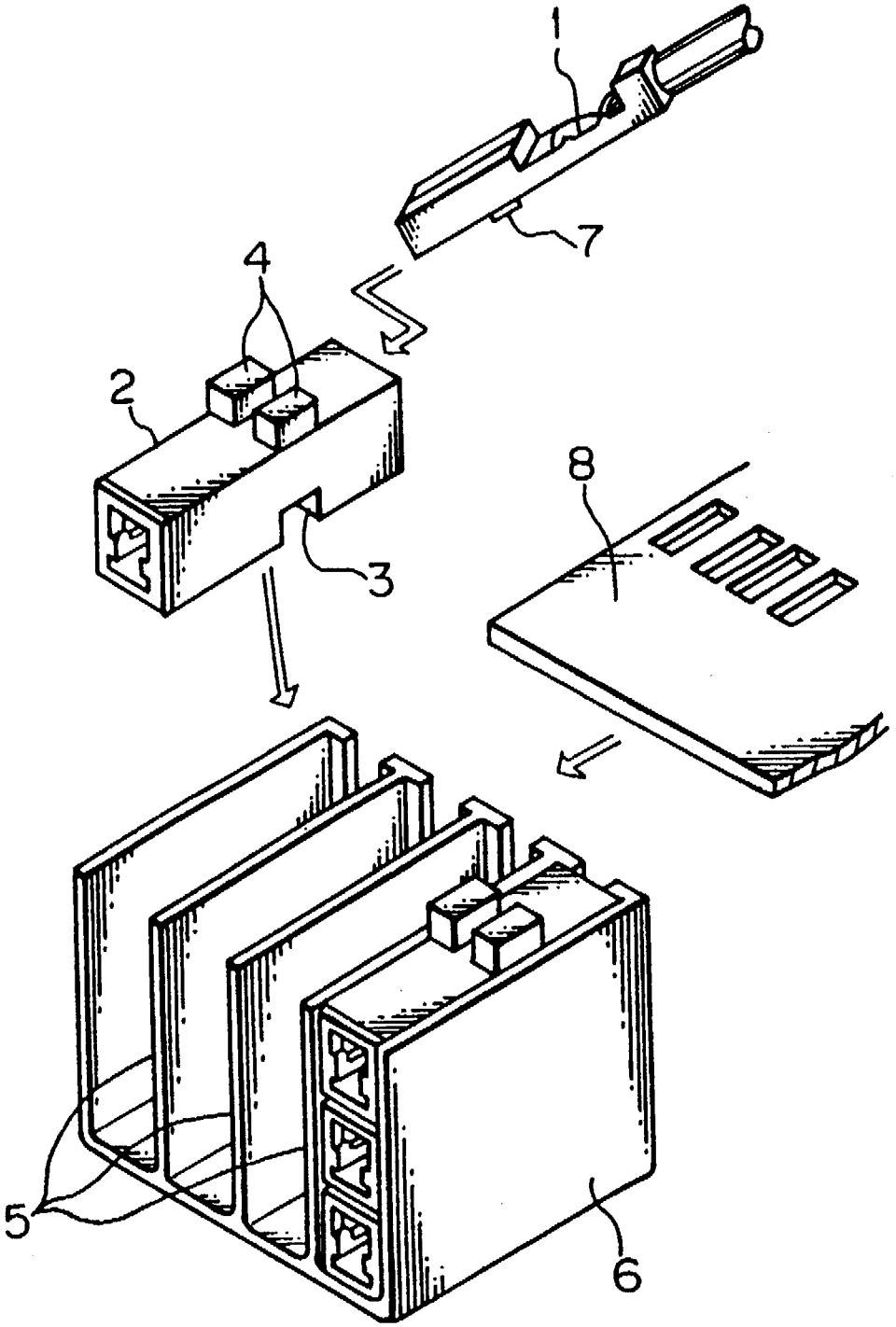
Fig. 8 PRIOR ART
FIG. 8 is an exploded perspective view of a conventional assembled connector.

FIG. 1 is an exploded perspective view of an embodiment of the assembled connector in accordance with the present invention. FIGS. 2 to 4 are longitudinal sectional views of the assembled connector, illustrating assembling steps of the connector. FIGS. 5 and 7 are exploded perspective views of another embodiment of the assembled connector in accordance with the present invention. FIG. 6 is a longitudinal sectional view of the connector shown in FIG. 5, illustrating an assembling step.

A basic structure of an assembled connector 10 of the present invention shown in FIGS. 1, 5 and 7 comprises: a main housing 20 having a plurality of terminal-containing chambers 1 juxtaposed in the interior thereof and being provided on a top portion with a lock arm 22 adapted to engage with a mating connector (not shown); a plurality of subhousings 30 having a plurality of terminal-containing chambers 31 juxtaposed in the interior thereof and being adapted to be detachably coupled to the main housing 20; a coupling mechanism 50 for coupling each of the subhousings 30 to the main housing 20 in a manner of slide engagement; and a retainer mechanism 60 for engaging with a terminal 40 at a regular position in each terminal-containing chamber 31 to hold the terminal in the regular position.

In the embodiment of the assembled connector 10 shown in FIG. 1, the coupling mechanism 50 is constructed so that the subhousing 30 is detachably coupled to the main housing 20 while sliding relatively on the main housing 20 in the same direction as an insertion direction of the terminal 40 with respect to the main housing 20.

In the embodiments of the assembled connector shown in FIGS. 5 and 7, the coupling mechanism 50 is detachably constructed so that the subhousing 30 is coupled to the main housing 20 while sliding relatively on the main housing 20 in a direction perpendicular to an insertion direction of the terminal 40 with respect to the main housing 20.

First of all, an embodiment of the assembled connector 10 shown in FIG. 1 is described below.

As shown in FIG. 1, the assembled connector 10 comprises a flat box-like main housing 20 provided with seven terminal-containing chambers 21 juxtaposed horizontally and two flat box-like subhousings 30 each provided with two terminal-containing chambers 31 juxtaposed horizontally. Each subhousing 20 is detachably coupled to a top wall on the main housing 20.

The main housing 20 is provided on its center top wall with a lock arm 22 which is adapted to lock a mating connector (not shown) upon engagement of both connectors. Two slide grooves 23, two stoppers 24, and three double lock ribs 25 are provided on each right and left spaces of the lock arm 22 on the top wall of the main housing 20. The slide groove 23 extends from a front end to an intermediate part on the top wall of the main housing 20 along the axis of each terminal-containing chamber 21 and is formed into a dovetail groove. The stopper 24 is provided on a rear end of the top wall of the main housing 20 and is formed into a reversed-L shape.

On the other hand, each subhousing 30 is provided on and in its bottom wall with two slide ridges 33 and two stop recesses 34 which are associated with the slide grooves 23 and stoppers 24, respectively. Each slide ridge 33 extends from a front end to an intermediate part on the bottom wall of the subhousing 30 along the axis of the terminal-containing chamber 31 in association with the slide groove 23 and is formed into a dovetail shape in cross section which is complementary to the slide groove 23. As shown by arrows in FIG. 1, both housings 20 and 30 are interconnected by inserting the slide ridges 33 into the front ends of the slide grooves 23 and sliding the ridges 33 on the grooves 23 rearwardly.

In this embodiment, the coupling mechanism 50 is constituted by the slide grooves 23 and stopper 24 formed on the main housing 20 and the slide ridges 33 and stop recesses 34 formed in each subhousing 30.

The stop recess 34 is formed in the lower rear end of the terminal-containing chamber 31 in the subhousing 30 to define a notch. The notch and depressed portion of the recess 34 are adapted to receive a vertical portion and a horizontal portion of the reversed-L stopper 24. This prevents the subhousing 30 from overrunning on and jumping from the main housing 20.

In FIGS. 2 to 4, 29 is a retainer which serves to double lock the terminal 40 inserted in the regular position in the terminal-containing chamber 21. The retainer 29 is inserted into the main housing 20 through an opening in a bottom wall as shown by an arrow in FIG. 3.

In this embodiment, although the slide grooves 23, slide ridges 33, stopper 24, and stop recess 34 constitute the coupling mechanism 50, another sliding engagement mechanism will be applied to the coupling mechanism 50. Each part may be replaced between the main housing and the subhousing.

The double lock rib 25 stands up on the rear end of the slide groove 23. The subhousing 30 is provided in its bottom wall with a through hole 35 which is associated with double lock rib 25 and is communicated with the terminal-containing chamber 31. The terminal 40 is provided with a stabilizer 41 projecting toward the through hole 35. When the terminal 40 is inserted into the terminal-containing chamber 31 through the rear end in the subhousing 30 and is moved to the regular position, the stabilizer 41 of the terminal 40 is primarily locked by a lance 36 on a lower part of the interior of the chamber 31. The double lock rib 25 is adapted so as to come into contact with the rear end edge of the stabilizer 41 from the rear side when the subhousing 30 which accommodates the terminal 40 in the regular position is coupled to the main housing 20. Thus, the through hole 35 is formed into an elongated opening so that the double lock rib 25 can move from the rear side to the front side in the hole 35.

In this embodiment, the retainer mechanism 60 is constituted by the double lock ribs 25 on the main housing 20 and the through holes 35 in each subhousing 30.

In this embodiment, although the double lock rib 25 comes into contact with the rear end edge of the stabilizer 41 of the terminal 40, the rib may come into contact with any other portion of the terminal 40, for example, a rear end of a barrel or a front end of a special recess so long as the rib 25 can push the terminal 40 forwardly. The subhousings may be stacked one after another so long as the coupling mechanism 50 and retainer mechanism 60 are provided on the subhousings 30.

Next, an operation of the embodiment of the assembled connector in accordance with the present invention will be explained below.

As shown in FIG. 2, when the subhousing 30 is mounted on the main housing 20 so that the rear ends of the slide ridges 33 on the subhousing 30 is disposed near the front ends of the slide grooves 23, the double lock ribs 25 on the main housing 20 enter the lower part of the terminal-containing chambers 31 through the through holes 35 in the subhousing 30. At this time, the double lock ribs 25 are disposed behind the stabilizer 41 of the terminal 40.

When the subhousing 30 is slid rearwardly, on the main housing 20, the slide ridges 33 engage with the slide grooves 23 and the reversed-L stoppers enter the terminal-containing chamber 31 through the stop recesses 34, thereby interconnecting both housings 20 and 30 at the front and rear ends.

The double lock rib moves in the elongated through hole 35 from the rear side to the front side and reaches the rear end edge of the stabilizer 41 of the terminal finally, if the terminal 40 is disposed in the regular position. If the terminal 40 is disposed in a half fitting position as shown in FIG. 4, the double lock rib 25 will contact the rear end edge of the stabilizer 41 before the interconnection of both housings 20 and 30 is completed. Then, the double lock rib 25 pushes the terminal 40 toward the regular position while the subhousing 30 is sliding on the main housing 20. When the interconnection of them is finished, the terminal 40 is disposed in the regular position. Accordingly, it is possible to continue the interconnection of them even if the terminal 40 is left in the half fitting position.

The double lock rib 25 on the main housing 20 moves relatively in the through hole 35 in the subhousing 30 upon the sliding operation to contact the rear end edge of the stabilizer 41 of the terminal 40, thereby pushing the terminal 40 to the regular position if the terminal 40 is disposed in a half fitting position, since the subhousing 30 can be coupled to the main housing 20 while being slid on the main housing 20 and the double lock rib 25 on the main housing 20 enters the through hole 35 in the subhousing 30.

Next, another embodiment of the assembled connector 10 shown in FIG. 5 will be described below.

FIG. 5 shows a perspective view of the embodiment of the assembled connector 10 of the present invention. In this embodiment, the main housing 20 and subhousing 30 constitute the assembled or block connector 10.

In FIG. 5, the main housing 20 as the one housing is formed into a flat box-like configuration and is provided with seven terminal-containing chambers 21 juxtaposed horizontally and with a lock arm 22 extending rearwardly on the center of a top wall. Each subhousing 30 as the other housing can be detachably mounted on the opposite sides of the lock arm 22 on the top wall of the main housing 20. The subhousing 30 is provided with two terminal-containing chambers 31 juxtaposed horizontally. The subhousing 30 is coupled to the main housing 20 by a coupling mechanism 50 described hereinafter with the bottom wall of the subhousing 30 in contact with the top wall of the main housing 20. The terminal-containing chambers 21 and 31 in the main housing 20 and subhousing 30 accommodate the terminals 40 each of which includes a box-like fitting portion 43 at the front side, a barrel portion 42 for clamping electrical wires at the rear side and a stabilizer 41 under the fitting portion 43.

It should be noted in this embodiment that each subhousing 30 as a housing unit is not limited to be mounted on the opposite sides of the lock arm 22 on the main housing 20. The subhousing 30 may be mounted on any place on the main housing 20 by means of a sliding engagement. An arrangement of the terminal-containing chambers in the housings 20 and 30 should not be limited to the illustrated embodiment so long as the retainer mechanism 60 can hold the terminal in the regular position.

The main housing 20 is provided on the front and rear sides with each engaging ridge 23*a* which extends in a width direction of the housing. The subhousing 30 is provided in its bottom wall with engaging grooves 33*a* associated with the engaging ridges 23*a*. The engaging ridges and grooves 23*a* and 33*a* have complementary dovetail shapes in cross section. The main housing 20 is provided on its top wall with stoppers 24.

In this embodiment, the coupling mechanism 50 is constituted by the engaging ridges 23*a* and stoppers 24 on the main housing 20 and the engaging grooves 33*a* in the subhousing 30.

Accordingly, after the subhousing 30 is disposed in parallel to the main housing 20 so that the engaging ridges 23*a* enter the engaging grooves 33*a*, the subhousing 30 is slid on the main housing 20 to the regular position. The subhousing 30 ceases from moving on the main housing 20 when stop recesses (not shown) in the subhousing 30 come into contact with the stopper on the main housing 20. When the engaging ridges and grooves 23*a* and 33*a* are interconnected, this structure can prevent both housings 20 and 30 from being disconnected in the same direction as the insertion direction of the terminal.

In this embodiment, the subhousing 30 slides on the upper surface of the main housing 20 in the width direction to engage with the main housing 20. The subhousing 30 is not limited to slide on the main housing 20 in the width direction so long as the subhousing 30 slides in a direction intersecting the insertion direction of the terminal. That is, the housings may be restrained to move relatively in a direction not vertical but parallel to the engaging surfaces of both housings. Accordingly, the subhousing 30 may move relatively in the intersecting direction on the main housing 20 so long as the subhousing cannot be disconnected in the direction parallel to the insertion direction of the terminal. The engaging ridges and grooves 23*a* and 33*a* are not limited to rectangular shapes in cross section. They may be formed into L-shaped configurations in cross section so long as they can slide relatively on each other.

The main housing 20 and subhousing 30 are provided between the engaging ridges 23*a* and between the engaging grooves 33*a* with a recess 25*a* and a ridge 26*a* and with a recess 35*a* and a ridge 36*a* which are arranged in a width direction of the housings so that the ridges 26*a* and 36*a* are opposed to the recesses 25*a* and 35*a*, respectively. Each of the recesses 25*a* and 35*a* communicates with each other terminal-containing chambers 21 and 31 and is open in each of side faces of the main housing 20 and subhousing 30. As shown in FIG. 6, the recess 25*a* in the main housing 20 is formed to conform the rear end of the fitting portion 43 of the terminal 40 in the terminal-containing chambers 21 while the recess 35*a* in the subhousing 30 is formed to conform the rear end of the stabilizer 41 under the fitting portion 43. On the other hand, ridges 26*a* and 36*a* are formed to enter the recesses 35*a* and 25*a*. The ridge 26*a* is opposed to the rear end edge of the stabilizer 41 when the ridge 26*a* enters the recess 35*a* while the ridge 36*a* is opposed to the rear rectangular end of the fitting portion 43 when the ridge 36*a* enters the recess 25*a*. In this embodiment, the recesses 25*a* and 35*a* and the ridges 36*a* and 26*a* constitute the retainer mechanism 60.

In this embodiment, the pair of recess 25*a* and ridge 26*a* and the pair of recess 35*a* and ridge 36*a* are disposed adjacent to each other. However, they may not be disposed adjacent to each other, so long as the recesses 25*a* and 35*a* are disposed to the ridges 36*a* and 26*a*, respectively. When the ridges 26*a* and 36*a* enter the mating recesses 35*a* and 25*a* to oppose the rear end edges of the terminals 40, it is generally important that the ridges 36*a* and 26*a* can prevent the terminals from coming out of the chambers rearwardly. Accordingly, the ridges 36*a* and 26*a* may not be opposed to the rear ends of the fitting portions 43 and stabilizers 41 of the terminals 40 as described in this embodiment. In general, the fitting portion 43 is shifted from the stabilizer 41 in the terminal 40. Accordingly, the recess and ridge may be disposed adjacent to each other by utilizing this shift arrangement.

FIG. 7 shows still another embodiment of the assembled connector of the present invention. In this embodiment, the ridges 26*a* and 36*a* are provided with taper faces 27 and 37 on parts of surfaces confronting to the terminals 40. In this structures, the taper faces 27 and 37 on the ridges 26*a* and 36*a* can push the terminal 40 to the regular position even if the terminal 40 is not disposed in the regular position. In particular, since the ridges 26*a* and 36*a* slide in the recesses 35*a* and 25*a*, it will be possible to smoothly push the terminal 40 by forming the taper faces 27 and 37 to be longer and more moderate. The recesses 25*a*, 35*a* and ridges 36*a*, 26*a* may be locked at the regular position and can also slide relatively.

Next, an operation of this embodiment will be described below.

First, the terminal 40 is inserted into each of the terminal-containing chambers 21 and 31 in the main housing 20 and subhousing 30. Second, the main housing 20 and subhousing 30 are disposed in parallel to each other to oppose the ends of the engaging ridges 23*a* to the side openings of the engaging grooves 33*a* and then the ridges 23*a* are slid into the grooves 33*a*. At the time when the ends of the engaging ridges 23*a* are opposed to the side openings of the engaging grooves 33*a*, the recesses 25*a*, 35*a* and ridges 36*a*, 26*a* in the retainer mechanism 60 are opposed to each other. At the time when the engaging ridges 23*a* enter the engaging grooves 33*a*, the ridges 26*a* and 36*a* enter the terminal-containing chambers 21 and 31 through the recesses 35*a* and 25*a*.

If the terminals 40 are inserted in the regular positions in the terminal-containing chambers 21 and 31, the ridges 26*a* and 36*a* move forward in the recesses 35*a* and 25*a* while coming into contact with the rear end edges of the stabilizers 41 and with the rear ends of the fitting portions 43. However, in the case where any terminal 40 is not inserted in the regular position in any chamber 21 or 31, the ridge 26*a* or 36*a* can not move forward since the fitting portion 43 or stabilizer 41 interferes with movement of the ridge. A worker can find that any terminal 40 is not disposed in the regular position when the subhousing 30 is not slid on the main housing 20. On the other hand, in the case where the ridges 26*a* and 36*a* are provided with the taper faces 27 and 37, the taper faces can push the terminal 40 to the regular position even if the terminal 40 is in a half-fitting position.

When the subhousing 30 is inserted into the regular position on the upper surface of the main housing 20, the engaging ridges 23*a* are firmly fitted to the engaging grooves 33*a*, so that the subhousing 30 will not be disconnected upward from the main housing 20. That is, the housings 20 and 30 are interconnected to each other without using an additional element such as an outer housing. Since the engaging ridges and grooves 23*a* and 33*a* are coupled to each other while the recesses 25*a*, 35*a* and ridges 36*a*, 26*a* are fitted to each other, the subhousing 30 is prevented from being disconnected relatively from the main housing 20 in the insertion direction of the terminal. Accordingly, when the assembled connector 10 of the present invention is coupled to and detached from the mating connector, the housings 20 and 30 will not be disconnected from each other.

Thus, since the subhousing 30 is slid relatively on the main housing 30 by means of the coupling mechanism while engaging with each other and mating ridges 36*a* and 26*a* enter the recesses 25*a* and 30*a*, which are communicated with the terminal-containing chambers 21 and 31, to retain the terminals 40 in the regular positions, the housings 20 and 30 are interconnected to each other without using any outer housing. Further, since the terminal 40 in the mating housing unit is retained in each mutual engaging surface, any additional retainer is not required.

It should be noted that in the assembled connector 10 of the present invention, a working efficiency will be enhanced if a great harness is produced by preparing a plurality of harnesses which are divided into small sections beforehand and interconnecting discrete housing units with separate harnesses to each other to form a united single connector upon an assembling step.

What is claimed is:

1. An assembled connector comprising:

a main housing having a plurality of terminal-containing chambers juxtaposed in the interior thereof and being provided on a top portion with a lock arm adapted to engage with a mating connector;

a plurality of subhousings having a plurality of terminal-containing chambers juxtaposed in the interior thereof and being adapted to be detachably coupled to said main housing;

a coupling mechanism for coupling each of said subhousings to said main housing in a manner of slide engagement; and a retainer mechanism for engaging with a terminal at a regular position in each terminal-containing chamber to hold said terminal in the regular position.

2. An assembled connector according to claim 1, wherein said coupling mechanism is constructed so that said subhousing is detachably coupled to said main housing while sliding relatively on said main housing in the same direction as an insertion direction of said terminal with respect to said main housing, and wherein said retainer mechanism includes through holes formed in an engaging wall of said subhousing and adapted to expose a stabilizer on a bottom of said terminal and protrusions formed on an engaging wall of said main housing and adapted to enter said terminal-containing chambers in said subhousing through said through holes, said protrusion being adapted to move in said through hole in said subhousing upon the relative sliding movement of said subhousing and to engage with a rear end of said stabilizer of said terminal in the regular position upon completing the relative sliding movement of said subhousing.

3. An assembled connector according to claim 2, wherein said protrusion on the engaging wall of said main housing is adapted to enter said terminal-containing chamber through said through hole to push said terminal in said terminal-containing chamber to said regular position in the chamber.

4. An assembled connector according to claim 1, wherein said coupling mechanism is detachably constructed so that said subhousing is coupled to said main housing while sliding relatively on said main housing in a direction perpendicular to an insertion direction of said terminal with respect to said main housing, and wherein said retainer mechanism includes recesses in and ridges on engaging walls of said main housing and subhousing, said recess communicating with said terminal-containing chamber and adapted to receive said ridge on the engaging wall of a mating housing to bring said ridge into entering said terminal-containing chamber therein upon relative sliding movement of said subhousing on said main housing.

5. An assembled connector according to claim 4, wherein said ridge is provided with a taper face on a part of a confronting surface to said terminal.

* * * * *